US005680899A

United States Patent [19]

Waid et al.

[11] Patent Number: 5,680,899

[45] Date of Patent: Oct. 28, 1997

[54] ELECTRONIC WELLHEAD APPARATUS FOR MEASURING PROPERTIES OF MULTIPHASE FLOW

[75] Inventors: Margaret C. Waid; Weldon J. Ginzel, Jr., both of Houston, Tex.

[73] Assignee: Halliburton Energy Services, Inc., Houston, Tex.

[21] Appl. No.: 482,371

[22] Filed: Jun. 7, 1995

[51] Int. Cl.[6] ..... E21B 47/00

[52] U.S. Cl. ..... 166/250.01; 166/250.15; 166/369; 166/66

[58] Field of Search ..... 166/53, 54, 66, 166/245, 250.01, 250.15, 369

[56] References Cited

U.S. PATENT DOCUMENTS

| | | | |
|---|---|---|---|
| 3,219,107 | 11/1965 | Brown et al. | 166/53 X |
| 3,629,859 | 12/1971 | Copland | 340/172.5 |
| 3,921,152 | 11/1975 | Hagar et al. | 166/66 X |
| 4,102,394 | 7/1978 | Botts | 166/64 |
| 4,545,632 | 10/1985 | Maier et al. | 339/18 R |
| 4,767,280 | 8/1988 | Markuson et al. | 166/66 X |
| 4,854,164 | 8/1989 | Rhoads | 166/53 X |
| 5,099,697 | 3/1992 | Agar | 73/66 X |
| 5,193,985 | 3/1993 | Escue et al. | 166/66 X |
| 5,335,730 | 8/1994 | Cotham | 166/374 |

*Primary Examiner*—Roger J. Schoeppel

*Attorney, Agent, or Firm*—J. M. Gilbreth; Robert W. Strozier; Gilbreth & Strozier, P.C.

[57] ABSTRACT

A system for producing hydrocarbons from a subterranean reservoir, the system including a multiplicity of wells producing hydrocarbons through flow lines, sensor units attached to each of the wells for monitoring hydrocarbon flow through the flow lines, and a portable electronics unit for operating the multiplicity of sensor units.

19 Claims, 3 Drawing Sheets

ELECTRONIC WELLHEAD APPARATUS FOR MEASURING PROPERTIES OF MULTIPHASE FLOW

BACKGROUND OF THE INVENTION

1. Field of the Invention

The present invention relates to multiphase flow measuring equipment. In another aspect, the present invention relates to multiphase flow measuring equipment for measuring properties of multiphase flow from a well. In even another aspect, the present invention relates to multiphase flow measuring equipment for measuring properties of multiphase flow from a well, utilizing a permanent well head apparatus with portable electronics for measuring the properties of the multiphase flow. In still another aspect, the present invention relates to multiphase flow measuring equipment for measuring properties of multiphase flow from a multiplicity of wells, utilizing permanent sensors at each well, and portable electronics for measuring the properties of the multiphase flow which communicates with each of the wells.

2. Description of the Related Art

Hydrocarbon wells must generally be monitored during production operations. Multiphase flow properties monitored includes, for example, water cut, gas cut, flow rates, pressure, and temperature.

Current equipment for monitoring such multiphase flow properties includes a sensor for monitoring the desired properties, and accompanying electronics which are integral to the sensor. Such electronics may include processor or computer components for operating the sensor, and for receiving, processing, storing and/or transmitting data.

Such monitoring equipment having integral sensor and electronic components suffer from one or more operating problems.

In certain harsh environments, such as in the cold North Slope of Alaska, the electronic component is generally not left mounted on the well. As a result, the monitoring equipment is unmounted after taking readings, resulting in increased labor cost and lost time. Alternatively, if it is undesirable or not feasible to unmounting the monitoring equipment after each reading, then enclosures may be built around the monitoring equipment as protection against harsh environments, resulting in increased space usage and cost.

Also, each flowrate sensor must be calibrated for certain flow patterns. Since these flow patterns are somewhat position dependent, the sensor should be remounted onto the exact position from which it was removed, or it will need to be recalibrated. In many instances, there is some difficulty in re-mounting the monitoring equipment at the precise location from which the last readings were taken. This variation in the monitoring position may affect the data somewhat.

Finally, there is a cost issue. The electronic component is generally much more expensive than the sensor component. Each sensor requires an electronic component that is redundant with the electronic components of other like sensors. Redundancy of electroncs eliminates the requirement for unique electronic components for each sensor.

Thus, there is a need in the art for improved equipment for monitoring hydrocarbon wells.

There is another need in the art for equipment for monitoring hydrocarbon wells in harsh environments which does not require removal of the sensors between monitorings.

There is even another need in the art for more cost effective monitoring equipment for monitoring a hydrocarbon well.

These and other needs in the art will become apparent to those of skill in the art upon review of this patent specification, including its claims and drawings.

SUMMARY OF THE INVENTION

It is an object of the present invention to provide for improved equipment for monitoring hydrocarbon wells.

It is another object of the present invention to provide for monitoring hydrocarbon wells in harsh environments which does not require removal of the sensors between monitorings.

It is even another object of the present invention to provide for more cost effective monitoring equipment for monitoring properties of a hydrocarbon well.

These and other needs in the art will become apparent to those of skill in the art upon review of this patent specification, including its claims and drawings.

According to one embodiment of the present invention there is provided an apparatus for monitoring a multiplicity of hydrocarbon wells each having a line through which hydrocarbons are produced. The apparatus includes a multiplicity of sensor units comprising a well head coupling for coupling the sensor unit to the well head, and a monitor for monitoring hydrocarbon flow line through the flow lines. The apparatus also includes portable electronics unit for operating the multiplicity of sensor units, communicatively coupled with one of the sensor units.

According to another embodiment of the present invention there is provided a system for producing hydrocarbons from a subterranean reservoir. The system includes a multiplicity of wells producing hydrocarbons through flow lines. The system also includes sensor units attached to each of the wells, and positioned to monitor hydrocarbon flow through flow lines. The system additionally includes a portable electronics unit for operating the multiplicity of sensor units, communicatively coupled with one of the sensor units, and adapted for subsequent coupling with the remaining sensor units.

According to even another embodiment of the present invention there is provided a system for producing hydrocarbons from a subterranean reservoir. The system includes a well producing hydrocarbons through a flow line, and includes a three phase flow sensor positioned to monitor hydrocarbon flow through the flow line.

DETAILED DESCRIPTION OF THE INVENTION

The well monitoring apparatus of the present invention utilizes sensors resident at or near the well to be monitored, and utilizes a remote or portable electronics unit which communicates with the sensors.

Figure 1:
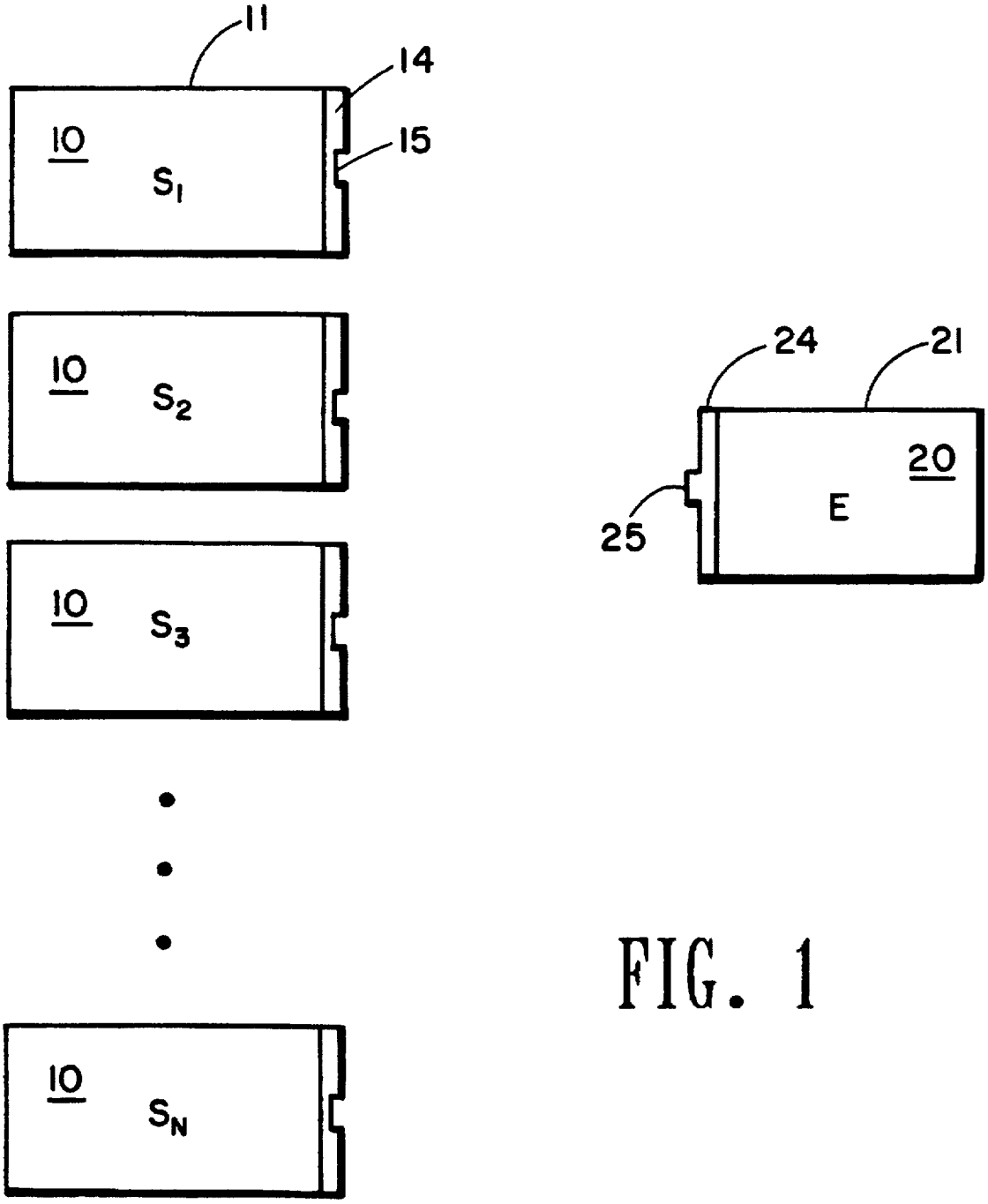
FIG. 1 is a schematic representation of one embodiment of the present invention showing sensors 10, labelled $S_1$ to $S_N$, each having a housing 11, modular connector 14 and modular plug recepticle 15, and electronics unit 20, labelled E, and having housing 21, modular connector 24 and modular plug 25. Further shown is well head coupling 51 for coupling sensor 10 to well head 50. Sensors 10 monitor flow from the well head 50 through flow line 53. Electronics unit 20 further comprises handle 60.

Referring now to FIG. 1 there is shown a schematic representation of one embodiment of the present invention showing sensors 10, labelled $S_1$ to $S_N$, each having a housing 11, modular connector 14 and modular plug recepticle 15, and electronics unit 20, labelled E, and having housing 21, modular connector 24 and modular plug 25.

Sensors 10 provide monitoring of water cut, gas cut, flow rates, pressure, temperature, and any other desired parameter. In the practice of the present invention, sensors 10 are placed permanently or semi-permanently in or on the flowline at the wellhead.

In the embodiment shown in FIG. 1, the electronics unit 20 provides for operation of the sensors 10 and provides the functions of acquiring, processing and recording of data gathered by sensors 10. Electronics unit 20 and the various sensors 10 are communicatively coupled together utilizing modular connectors 14 on sensors 10 and 24 on electronics unit 20. Modular connectors 14 and 24 are interlocking and provide data connection. Where necessary, modular connectors 14 and 24 can be adapted to provide electrical power from electronics unit 20 to sensors 10.

Electronics unit 20 is portable and by being movable between the various sensors 10, eliminates the need to have a dedicated integral electronics unit for each of the sensors 10. As the sensors 10 are generally more suitable for harsh environments than the electronics unit 20, the portability of unit 20 allows for it to be removed and safeguarded from the elements when not in use. Finally, as sensors 10 remain in place while electronics unit 20 is removed, sensors 10 do not have to be remounted and repositioned between each data taking cycle.

Figure 2:
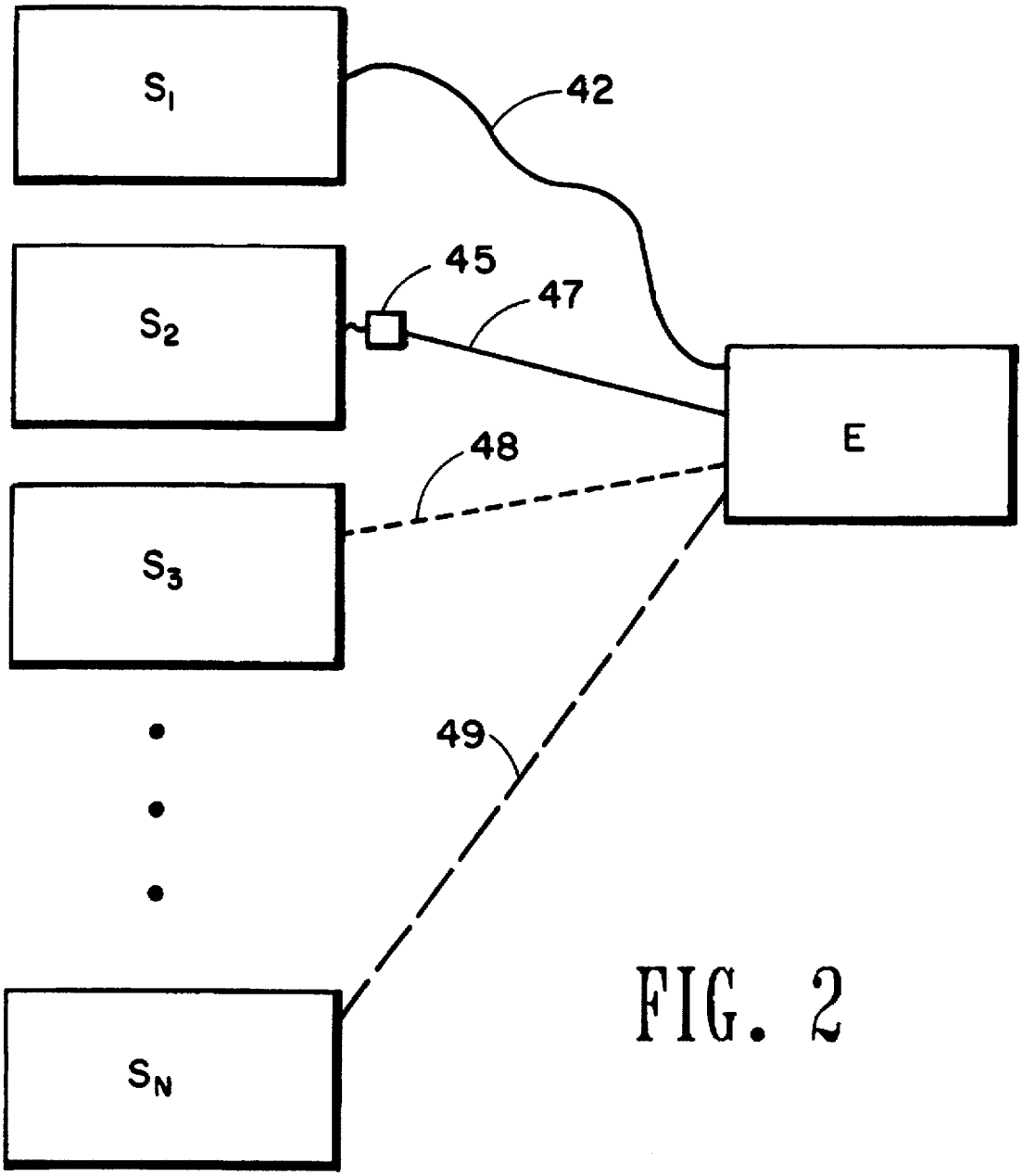
FIG. 2 is a schematic representation of the present invention showing various embodiments of connecting sensors $S_1$ through $S_N$ to electronics unit E, including by hard wire 42, modem 45 with telephone line 47, radio signal 48, acoustic signal 49.

Referring now to FIG. 2 there is provided a schematic representation of the present invention showing various embodiments of coupling sensors $S_1$ through $S_N$ in communication with electronics unit E, including by hard wire 42, modem 45 with telephone line 47, radio signal 48, acoustic signal 49.

In the embodiment of FIG. 1, electronics unit 20 is communicatively coupled to the various sensors 10 via modular connectors 14 and 15. However, it is to be understood that any suitable communication connector may be utilized to communicatively couple electronics unit 20 and sensors 10.

For example, as shown in FIG. 2, sensor $S_1$ is directly connected to electronics unit E via wire, line or cable 42. Other wired methods include optical cable. Also, sensor $S_2$ is remotely connected to electronics unit E via modem 45 and telephone line 47. Of course, a cordless telephone or cellular telephone may be utilized. Wireless methods include linking sensor $S_3$ with electronics unit E via radio frequency waves 48, and also includes linking sensor $S_N$ with electronics unit E via acoustic signal 49. Other wireless methods include satellite linkups.

The separation of the electronics unit 20 from the sensors 10 eliminates the need for a redundant electronics unit. Pooling of various lines from various wells into a gathering point will reduce the number of sensors required.

Figure 3:
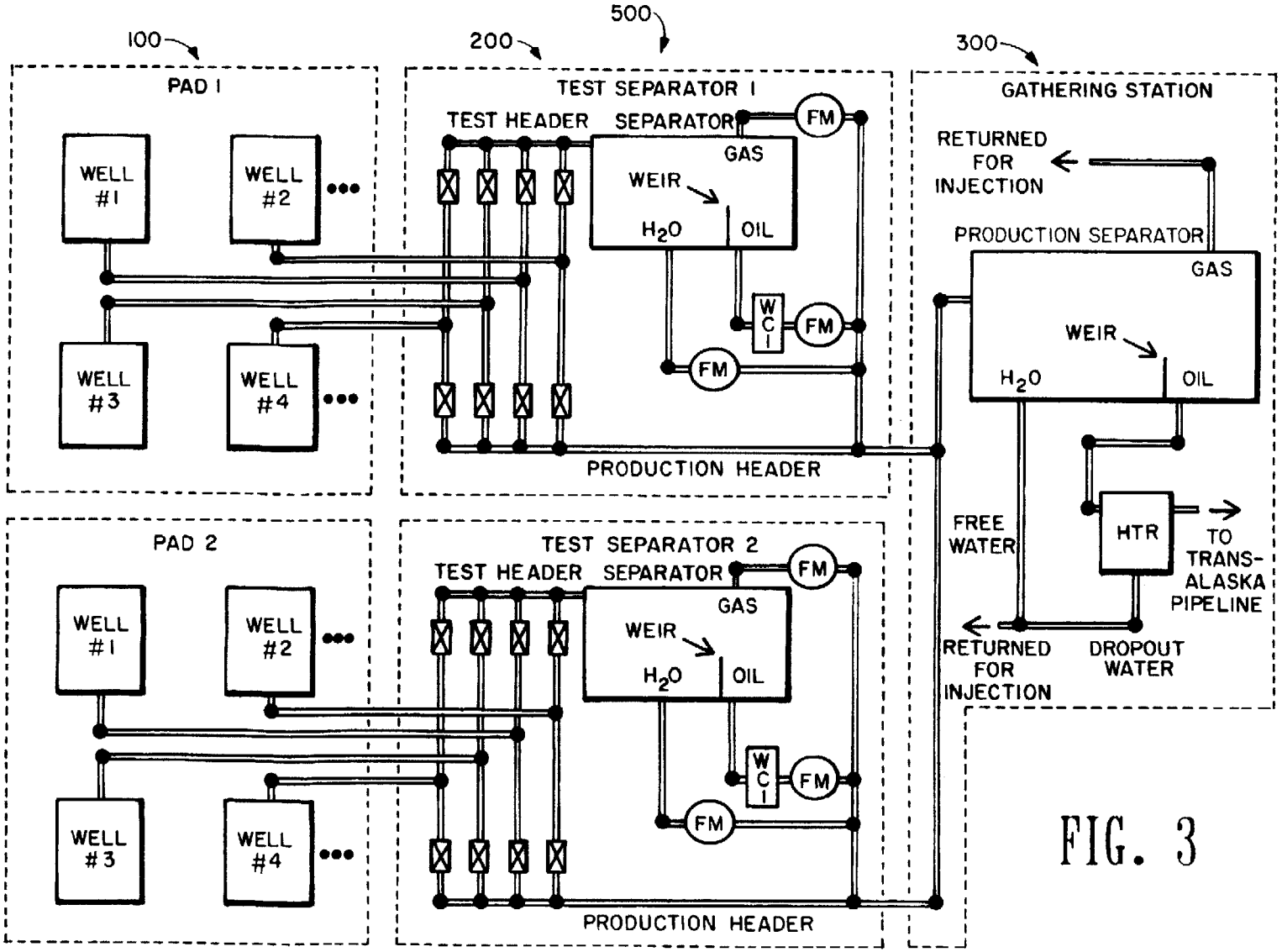
FIG. 3 is a schematic representation of testing unit 500 showing pads 100, test separators 200 and gathering stations 300.

Referring now to FIG. 3 there is shown a schematic representation of testing unit 500 showing pads 100, test separators 200 and gathering stations 300.

While each pad 100 is illustrated as having 4 wells, a pad typically contains 10 to 30 wells. These wells are not all necessarily production units as some are used for injection. Each producing well is routed to the test separator building 200 where the lines are plumbed to form two headers: 1) the test header and 2) the production header. The lines are valved such that if production from one well is routed to the test header then it is shutoff from the production header. In this fashion each well can be individually tested for its production capabilities.

Well testing consists of temporarily routing each well to a "test" separator where the three phases (oil, gas, and water) are separated and then measured for production rates. Testing usually takes about 8 hours. The first 4 hours are a "purge period" that allows the separator to stabilize to the new test well conditions. The next 4 hours each phase is measured and then extrapolated for a 24 hour period. Note that separators do not perfectly separate all phases from one another for a variety of reasons. For example oil/water emulsions are often hard to break or sometimes there will be gas entrainment within the emulsions. Sand production can limit separator efficiencies by settling on the bottom and effectively reducing the separator volume or capacity. Also depending on temperatures, viscosities, and production rates the separators may not be given enough time to allow complete fluid separation. For these reasons it is standard practice to include a watercut measurement on the oil leg of the separator. In some cases (depending on the configuration of the separator) water cuts greater than 90% may be seen, although water cuts less than 25% are more typical. Flow measurement of each phase is typically accomplished using turbine meters.

After testing all phases are recombined and routed back to the production header and then routed to the gathering center. At the gathering center 300 larger "production" separators separate each of the three phases. Any water in the oil leg is sent to a heater treater where the water fraction is removed from the oil. The oil is then transported away from the gathering station.

The water and gas phases out of the separator are relatively pure and as such their flow rates can be accurately measured using traditional instruments such as turbine meters. However the oil leg of the separator is not pure and will typically contain some water fraction. Therefore, some method of measuring the amount of water is necessary for accurate production analysis.

In cases where the water fraction is less than 25%, capacitance probes are typically used without a loss in accuracy. If these probes are used when fractions are above 25%, software will automatically default the cut measurement based upon a previous sample. For example if a drawn sample has shown a 40% water holdup, then any measurement above 25% will default to a 40% reading. Capacitance probes are thus limited in their range of response, making them unattractive in slug flow conditions. These probes are typically not full bore measurements. This instrument also requires a flow meter (typically a turbine meter) in order to determine the mass flow rate. Commercial instruments exist for those values above a 40% reading.

In the practice of the present invention, the flowmeters "FM" and water cut instruments "WCI" shown in FIG. 3 are preferably sensors having portable or remote electronics, as is taught herein.

Finally, in an alternative embodiment of the present invention, the separators of Test Separator 1 and Test Separator 2, as shown in FIG. 3, may be eliminated by utilizing a three phase flowmeter. Eliminating these separators is desirable to free up valuable platform space for other uses, or to reduce the pad/platform size and thus the cost. Savings are also realized in the equipment, installation and maintenance costs associated with the separators.

While this invention has been illustrated with respect to multiple wells on a single pad, it is to be understood that the actual invention is not so limited. A further embodiment, which illustrates other uses of this invention, is beneficial to wells which are located in a region, however remote from each other. For example, wells in a field may be hundreds of feet or even several miles from each other. Separators would be extremely costly because one separator may not be practical for multiple wells. This invention would provide an economical means for monitoring multiphase flow. Once all of the sensors are installed on the wells, a single individual with one portable unit could accomplish the testing for an entire field of many wells, or even of wells in multiple fields.

The present invention can be advantageously utilized to monitor multiphase flow properties, for example, water cut, gas cut, flow rates, pressure, temperature, conductivity, resistivity, density and composition.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

I claim:

1. An apparatus for monitoring a multiplicity of hydrocarbon wells each having a flow line through which hydrocarbons are produced, the apparatus comprising:

(a) a multiplicity of sensor units each comprising a well head coupling for coupling the sensor unit to the well head, a monitor for monitoring hydrocarbon flow through the flow lines, and a communications coupling;

(b) a portable electronics unit for operating the multiplicity of sensor units, comprising a communication coupling operatively engaged with the communications coupling of one the sensor units.

2. The apparatus of claim 1 wherein the sensor units comprise a modular communication coupling, and wherein the portable electronics unit comprises a modular communications coupling shaped to operatively engage the sensor unit modular communications coupling.

3. The apparatus of claim 1 wherein the sensor units comprise sensors for monitoring at least one of water cut, gas cut, flow rates, pressure, temperature, conductivity, resistivity, density and composition.

4. The apparatus of claim 1 wherein the sensor communications coupling and the electronics unit communications coupling are both telecommunications couplings.

5. The apparatus of claim 1 wherein the sensor communications coupling and the electronics unit communications coupling are both hard wired together.

6. The apparatus of claim 1 wherein the sensor is a three phase flow sensor.

7. The apparatus of claim 1 wherein the sensor units comprise a modular communication coupling, and wherein the portable electronics unit comprises a modular communications coupling shaped to operatively engage the sensor unit modular communications coupling, and the sensor units comprise sensors for monitoring at least one of water cut, gas cut, flow rates, pressure, temperature, conductivity, resistivity, density and composition.

8. A system for producing hydrocarbons from a subterranean reservoir, the system comprising (a) a multiplicity of wells producing hydrocarbons through flow lines;

(b) sensor units attached to each of the wells, positioned to monitor hydrocarbon flow through flow lines, and comprising a communications coupling;

(c) a portable electronics unit for operating the multiplicity of sensor units, comprising a communications coupling operatively engaged with the communications coupling of one of the sensor units.

9. The system of claim 8 wherein the sensor units comprise a modular communication coupling, and wherein the portable electronics unit comprises a modular communications coupling shaped to operatively engage the sensor unit modular communications coupling.

10. The system of claim 8 wherein the sensor units comprise sensors for monitoring at least one of water cut, gas cut, flow rates, pressure, temperature, conductivity, resistivity, density and composition.

11. The system, of claim 8 wherein the sensor communications coupling and the electronics unit communications coupling are both telecommunications couplings.

12. The system of claim 8 wherein the sensor communications coupling and the electronics unit communications coupling are both hard wired together.

13. The system of claim 8 wherein the sensor units comprise a modular communication coupling, and wherein the portable electronics unit comprises a modular communications coupling shaped to operatively engage the sensor unit modular communications coupling, and the sensor units comprise sensors for monitoring at least one of water cut, gas cut, flow rates, pressure, temperature, conductivity, resistivity, density and composition.

14. The apparatus of claim 8 wherein the sensor is a three phase flow sensor.

15. A system for producing hydrocarbons from a subterranean reservoir, the system comprising (a) a well producing hydrocarbons through a flow line; and (b) a three phase flow sensor positioned to monitor hydrocarbon flow through the flow line.

16. The system of claim 15 wherein the sensor comprises a communications coupling, the system further comprising:

(c) a portable electronics unit for operating the sensor, comprising a communications coupling operatively engaged with the commincations coupling of one of the sensor units.

17. The system of claim 16 wherein the sensor unit comprises a modular communication coupling, and wherein the portable electronics unit comprises a modular communications coupling shaped to operatively engage the sensor unit modular communications coupling.

18. The system of claim 16 wherein the sensor communications coupling and the electronics unit communications coupling are both telecommunications couplings.

19. The system of claim 16 wherein the sensor communications coupling and the electronics unit communications coupling are both hard wired together.

* * * * *